US007460089B2

(12) United States Patent
Kim et al.

(10) Patent No.: US 7,460,089 B2
(45) Date of Patent: Dec. 2, 2008

(54) DRIVING APPARATUS OF PLASMA DISPLAY PANEL

(75) Inventors: Jin-Sung Kim, Suwon-si (KR); Woo-Joon Chung, Suwon-si (KR); Seung-Hun Chae, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 579 days.

(21) Appl. No.: 11/075,868

(22) Filed: Mar. 10, 2005

(65) Prior Publication Data

US 2005/0200566 A1 Sep. 15, 2005

(30) Foreign Application Priority Data

Mar. 11, 2004 (KR) ..... 10-2004-0016440

(51) Int. Cl.
*G09G 3/28* (2006.01)

(52) U.S. Cl. ..... 345/60; 345/66

(58) Field of Classification Search ..... 345/60–69; 315/169.3, 169.4, 169.5, 169.1
See application file for complete search history.

(56) References Cited

U.S. PATENT DOCUMENTS 5,745,086 A 4/1998 Weber ..... 345/63
7,026,765 B2 * 4/2006 Lee ..... 315/169.1

FOREIGN PATENT DOCUMENTS

| | | |
|---|---|---|
| CN | 1405746 | 3/2003 |
| CN | 1573867 | 2/2005 |
| JP | 11-065524 | 3/1999 |
| WO | 02-058041 | 7/2002 |
| WO | 03-015066 | 2/2003 |

* cited by examiner

*Primary Examiner*—Nitin Patel
(74) *Attorney, Agent, or Firm*—H.C. Park & Associates, PLC

(57) ABSTRACT

A driving apparatus of a plasma display panel. In a scan electrode driving circuit, a drain of a first transistor is coupled to a scan electrode, and a driver of the first transistor is coupled to the gate and a source of the first transistor. During a reset period, the driver turns on the first transistor and reduces a voltage at a scan electrode and then turns off the first transistor so as to gradually reduce the voltage of the scan electrode by floating the scan electrode. Further, a selecting voltage may be applied to the scan electrode by turning on the first and second transistors during an address period. Thus, the transistor used during the reset period may be used in the address period.

19 Claims, 8 Drawing Sheets

DRIVING APPARATUS OF PLASMA DISPLAY PANEL

CROSS REFERENCE TO RELATED APPLICATION

This application claims priority to and the benefit of Korean Patent Application No. 10-2004-0016440, filed on Mar. 11, 2004, which is hereby incorporated by reference for all purposes as if fully set forth herein.

BACKGROUND OF THE INVENTION

1. Field of the Invention

The present invention relates to a driving apparatus of a plasma display panel (PDP), and more particularly, the present invention relates to a circuit for driving a scan electrode of the PDP.

2. Discussion of the Background

Generally, a PDP uses plasma generated by gas discharge to display characters or images, and it may include more than several tens of thousands to millions of pixels arranged in a matrix. A PDP may be classified as a direct current (DC) type or an alternating current (AC) type according to driving voltage waveforms and discharge cell structures.

When driving the AC PDP, a unit frame may be divided into a plurality of subfields for time division gray scale display, and each subfield may include a reset period, an address period, and a sustain period.

In the reset period, wall charges formed by a previous sustain-discharge may be erased, and each cell is initialized to stably perform a subsequent addressing operation. In the address period, each cell is selected to be turned on or turned off, and wall charges accumulate in the cells that are selected to be turned on (i.e., addressed cells). In the sustain period, a sustain discharge waveform may be alternately applied to a scan electrode and a sustain electrode to cause a discharge that displays an image on the addressed cell.

Conventionally, a ramp waveform may be applied to a scan electrode to establish wall charges in the reset period, as shown in FIG. 1 and disclosed in U.S. Pat. No. 5,745,086. In other words, a gradually rising ramp waveform may be applied to the scan electrode, followed by a gradually falling ramp waveform. In this case, since an ability to precisely control the wall charges may significantly depend on the gradient of the ramp, the wall charges may not be precisely controlled within a predetermined time frame.

Further, although a final voltage $V_{nf}$ of the ramp falling waveform and a voltage $V_{scl}$ applied to a selected scan electrode during the address period may be the same, separate transistors may be used for respectively transmitting the voltages $V_{nf}$ and $V_{scl}$. In other words, a driver may have to be coupled to a contact of the scan electrode and to the transistor, which may be incapable of applying the pulse type voltage $V_{nf}$. Thus, separate transistors may be necessary: one for transmitting the voltage $V_{nf}$, and the other for the transmitting the voltage $V_{scl}$.

SUMMARY OF THE INVENTION

The present invention provides a driving apparatus to control wall charges within a predetermined time.

Further, the present invention may use a same transistor during a reset period and an address period.

Additional features of the invention will be set forth in the description which follows, and in part will be apparent from the description, or may be learned by practice of the invention.

The present invention discloses a driving apparatus of a plasma display panel having a capacitive load formed by at least two electrodes. The driving apparatus includes a first transistor having a first main end coupled to a first electrode of the capacitive load, a capacitor having a first end coupled to a second main end of the first transistor and a second end coupled to a first power supplying a first voltage so as to receive charges from the capacitive load when the first transistor is turned on. A second transistor is coupled between the second main end of the first transistor and a second power supplying a second voltage. A voltage of the first electrode is reduced by repeatedly turning the first transistor on and off during a reset period. The first transistor and the second transistor are turn on during the address period so as to apply the second voltage to the first electrode.

The present invention also discloses a driving apparatus of a plasma display panel having a capacitive load formed by at least two electrodes. The driving apparatus includes a first transistor having a first main end coupled to a first electrode of the capacitive load, a driver coupled between a control end and a second main end of the first transistor and a first power supplying a first voltage, and a second transistor coupled between the second main end of the first transistor and a second power supplying a second voltage. The driver controls an operation of the first transistor to gradually reduce a voltage at the first electrode during a reset period. The second voltage is supplied to the first electrode when the first transistor and the second transistor are turned on during an address period It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
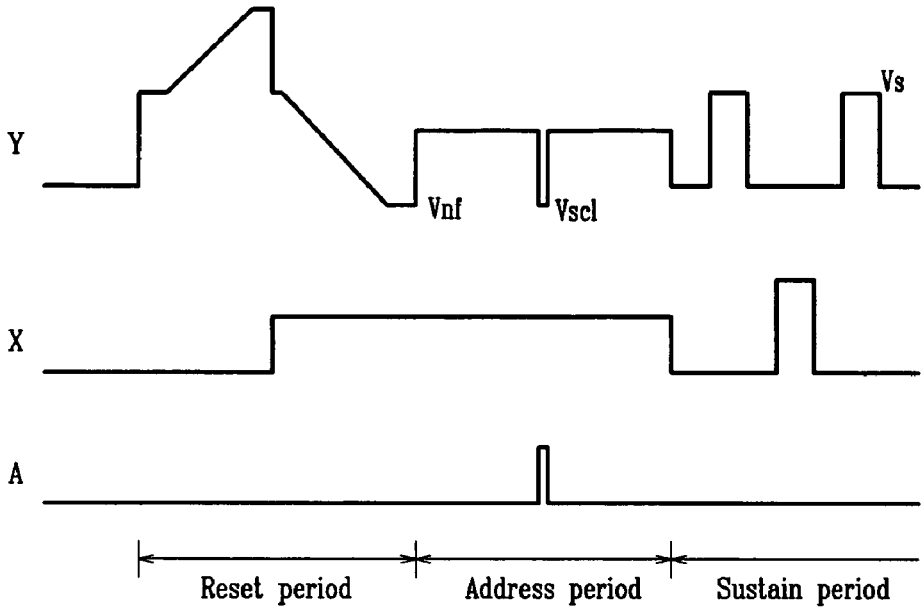
FIG. 1 (Prior Art)
FIG. 1 shows a conventional driving waveform of a PDP.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

In the drawings, illustrations of elements having no relation with the present invention are omitted in order to more clearly present the subject matter of the present invention. In the specification, the wall charges refer to charges that accumulate to the electrodes and are formed proximately to the respective electrodes on the wall (e.g., dielectric layer) of the discharge cells. The wall charges do not actually touch the electrodes themselves, but they may be described herein as being "formed on", "stored on", and/or "accumulated to" the electrodes.

A driving apparatus of a PDP according to an exemplary embodiment of the present invention will be described in detail hereinafter with reference to the annexed drawings.

Figure 2:
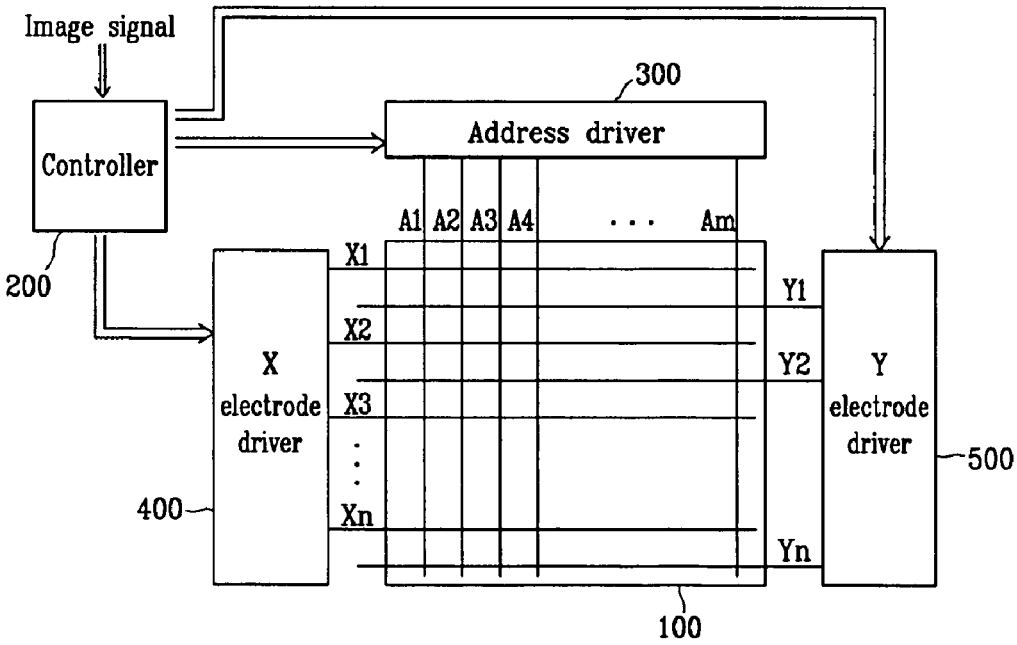
FIG. 2 is a schematic view of a PDP according to an exemplary embodiment of the present invention.

FIG. 2 schematically shows a plasma display device according to an exemplary embodiment of the present invention.

Referring to FIG. 2, the plasma display device may include a plasma display panel (PDP) 100, a controller 200, an address driver 300, a sustain (X) electrode driver 400, and a scan (Y) electrode driver 500.

The PDP 100 may include address electrodes $A_1$ to $A_m$ arranged in columns, and pairs of sustain electrodes $X_1$ to $X_n$ and scan electrodes $Y_1$ to $Y_n$ alternately arranged in rows. Ends of the sustain electrodes $X_1$ to $X_n$ may be coupled together. Additionally, the PDP 100 may include a substrate (not shown) on which the sustain electrodes and the scan electrodes are arranged, and a substrate (not shown) on which the address electrodes are arranged. These substrates are sealed together and define a discharge space therebetween, and the address electrodes $A_1$ to $A_m$ may be orthogonal to the scan electrodes $Y_1$ to $Y_n$ and the sustain electrodes $X_1$ to $X_n$. A discharge cell may be formed at a portion of the discharge space corresponding to an intersection of an address electrode and a scan and sustain electrode pair.

The controller 200 receives an external image signal and outputs a sustain electrode driving control signal, a scan electrode driving control signal, and an address driving control signal. Further, the controller 200 may divide a single frame into a plurality of sub-fields, where a subfield may include a reset period, an address period, and a sustain period with respect to temporal variations in operations.

The address driver 300 receives the address driving control signal from the controller 200 and transmits a data signal to the address electrodes A1 to Am to select desired discharge cells. The X electrode driver 400 and the Y electrode driver 500 receive the sustain and scan electrode driving control signals from the controller 200 and apply driving voltages to the sustain and scan electrodes, respectively.

Hereinafter, a driving waveform that may be applied to the address electrodes A1 to Am, the sustain electrodes X1 to Xn, and the scan electrodes Y1 to Yn will be described with reference to FIG. 3 and FIG. 4. A discharge cell formed by an address electrode, a sustain electrode, and a scan electrode will also be described below.

Figure 3:
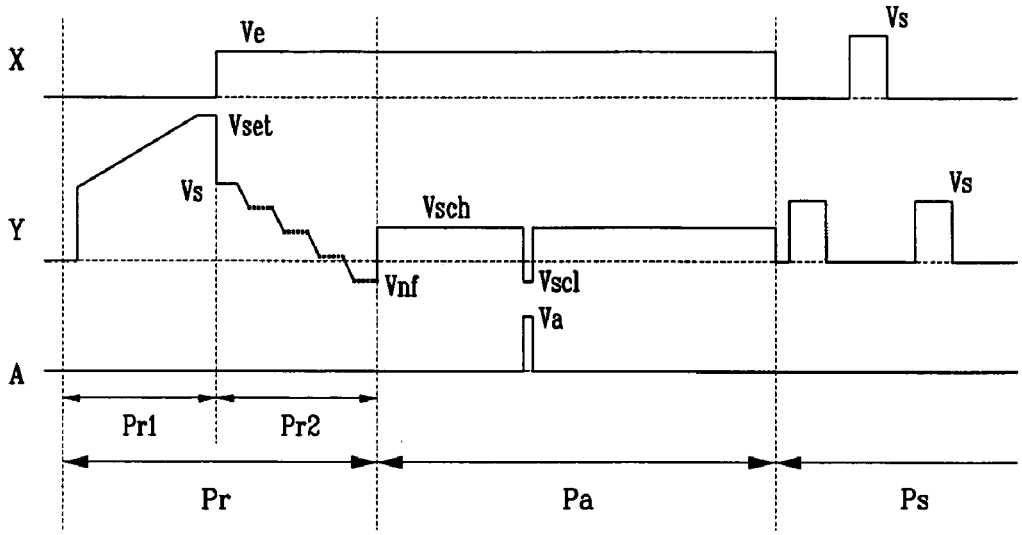
FIG. 3 is a driving waveform of the PDP according to an exemplary embodiment of the present invention.
Figure 4:
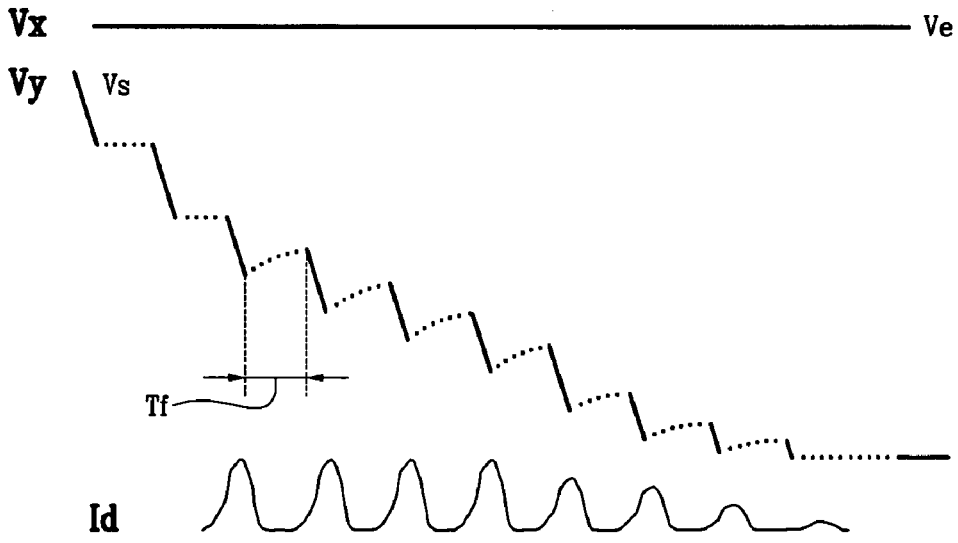
FIG. 4 shows a voltage of an electrode and a discharge current in response to the driving waveform of FIG. 3.

FIG. 3 shows a driving waveform of the PDP according to an exemplary embodiment of the present invention, and FIG. 4 shows a voltage of a Y electrode and a discharge current with respect to the driving waveform of FIG. 3.

As shown in FIG. 3, a subfield may include a reset period $P_r$, an address period $P_a$, and a sustain period $P_s$, and the reset period $P_r$ may include a rising period $P_{r1}$ and a falling period $P_{r2}$.

Generally, positive charges may be formed on the sustain electrode, and negative charges may be formed on the scan electrode when the last sustain-discharge finishes in the sustain period. In the rising period $P_{r1}$ of the reset period Pr, a waveform gradually rising from a voltage of $V_s$ to a voltage of $V_{set}$ may be applied to the scan electrode while biasing the sustain electrode at 0V. During this period, a weak reset discharge may occur from the scan electrode to the address electrode and the sustain electrode, respectively, thus accumulating positive wall charges on the scan electrode and negative wall charges on the address electrode and the sustain electrode.

As shown in FIG. 3 and FIG. 4, in the falling period $P_{r2}$ of the reset period $P_r$, the voltage applied to the scan electrode may decrease by a predetermined voltage, and then the scan electrode may be floated, during a period $T_f$, by stopping the voltage applied thereto, while biasing the sustain electrode at the voltage of $V_e$. This process of reducing the voltage applied to the scan electrode and floating the scan electrode may be repeated.

When a difference between the voltage of $V_x$ at the sustain electrode and the voltage of $V_y$ at the scan electrode exceeds a discharge firing voltage $V_f$, a discharge may occur between the sustain and scan electrodes. In other words, a discharge current $I_d$ flows through the discharging space. Floating the scan electrode after starting the discharge changes the voltage at the scan electrode on the basis of the amount of wall charges because an electric charge is not supplied from an external power source. Accordingly, the changed amount of the wall charge may reduce the voltage within the discharge space, thus quenching the discharge with a small amount of wall charges. In other words, the wall charges formed on the sustain electrode and the scan electrodes may rapidly reduce the voltage in the discharge space so that an intense discharge quenching may occur. When the scan electrode is floated after its voltage has fallen to create a discharge, the wall charges may be reduced and the intense discharge quenching may also be generated within the discharge space. Repeatedly reducing the voltage of the scan electrode and then floating it may form desired wall charges on the sustain and scan electrodes.

As described above, the discharge may be quenched with a smaller amount of wall charges to more precisely control the wall charges. Further, a conventional reset method of applying a gradually falling ramp waveform may slowly decrease the voltage at the scan electrode to prevent an intense discharge and control the wall charges. Since the gradient of the ramp waveform may control discharge intensity, acceptable values of the gradient may be restricted, which may increase the amount of time for carrying out the reset operation. Contrarily, a reset method, using the floating state, according to an exemplary embodiment of the present invention may control the intensity of the discharge using a voltage drop based on the wall charge, which may reduce the time required for the reset period.

The time for reducing the voltage at the scan electrode should not be so long that it causes an excessively intense discharge. Therefore, the time for applying a voltage to the scan electrode may be shorter than the time for floating the scan electrode.

Referring to FIG. 5A, FIG. 5B, FIG. 5C, FIG. 5D and FIG. 5E, the intense discharge quenching that may be caused by floating will be described hereinafter with reference to the sustain and scan electrodes in the discharge cell, since the discharge generally occurs therebetween.

Figure 5A:
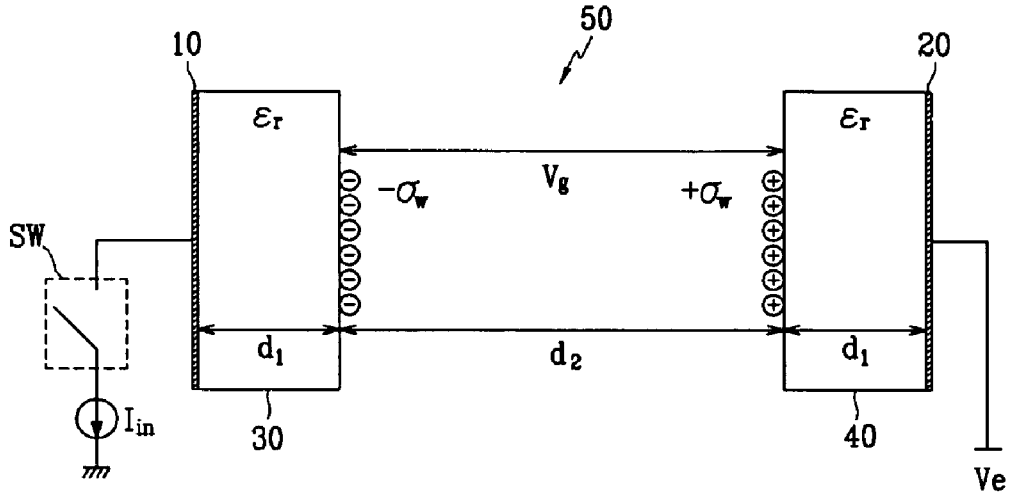
FIG. 5A is a modeled diagram showing a discharging cell formed by a sustain electrode and a scan electrode.
Figure 5B:
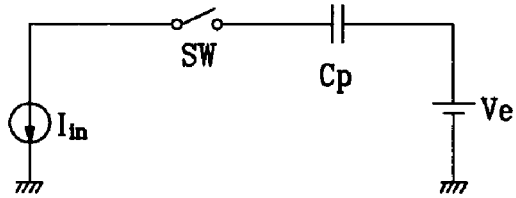
FIG. 5B shows an equivalent circuit of FIG. 5A.
Figure 5C:
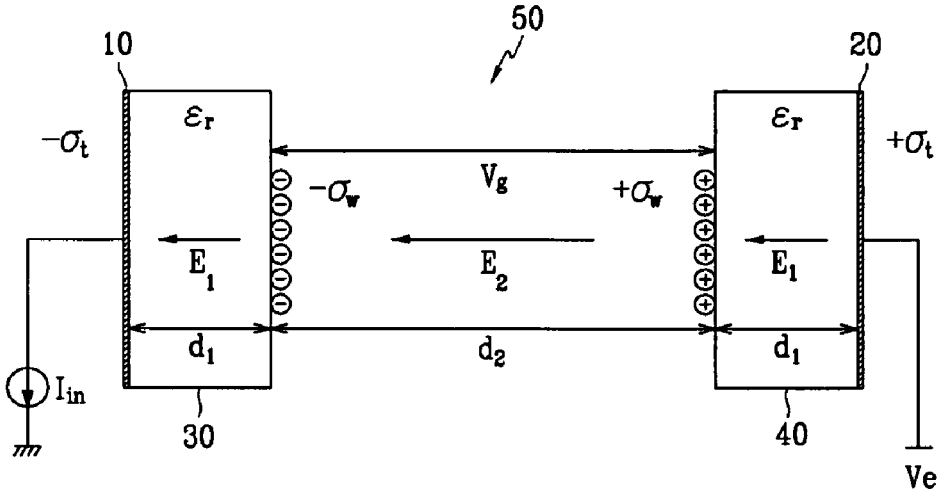
FIG. 5C shows a state in which a voltage is applied when a discharge is not occurring in the discharging cell of FIG. 5A.
Figure 5D:
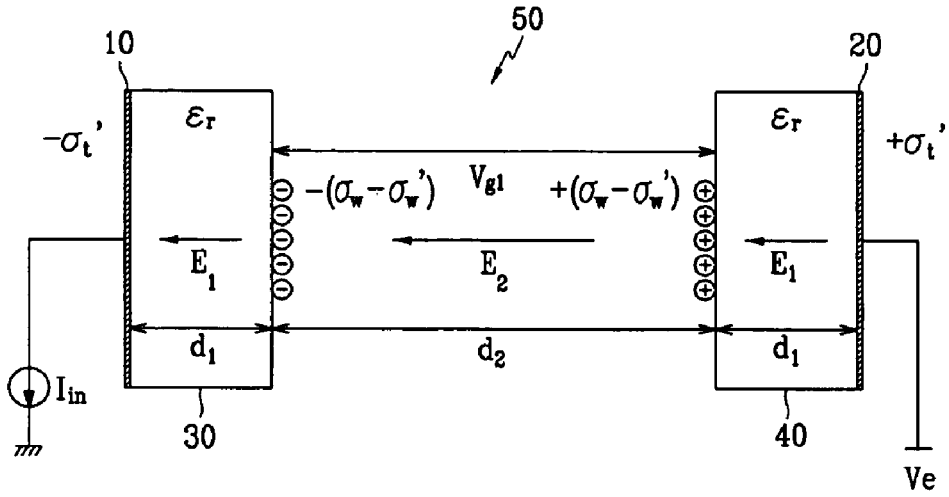
FIG. 5D shows a state in which a voltage is applied when a discharge is occurred in the discharging cell of FIG. 5A.
Figure 5E:
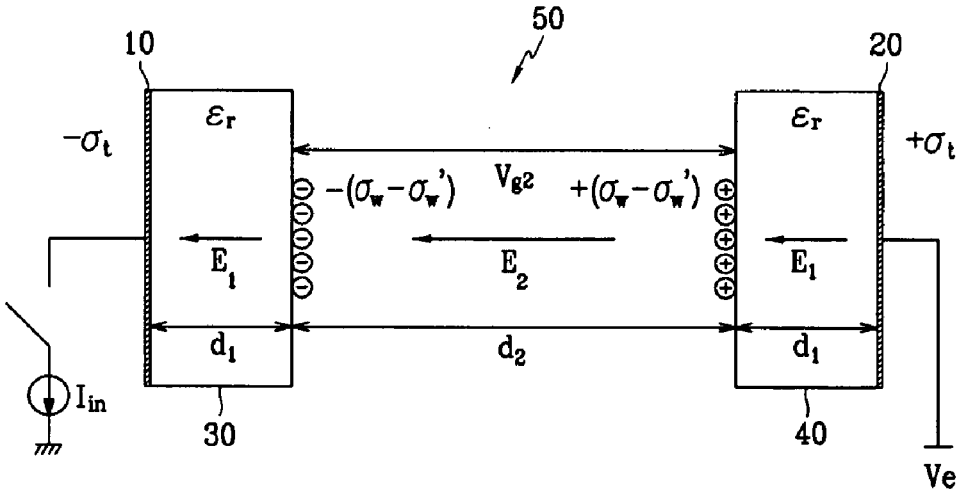
FIG. 5E shows a floating state when a discharge is occurring in the discharging cell of FIG. 5A.

FIG. 5A is a modeled diagram showing a discharge cell formed by a sustain electrode and a scan electrode, and FIG. 5B shows an equivalent circuit of FIG. 5A. FIG. 5C shows a case when no discharge occurs in the discharge cell of FIG. 5A, FIG. 5D shows a state in which a voltage is applied when a discharge occurs in the discharge cell, and FIG. 5E shows a floated state when a discharge occurs in the discharge cell. For ease of description, charges $-\sigma_w$ and $+\sigma_w$ are respectively formed at the scan electrode and the sustain electrode 10 and 20 in an earlier stage in FIG. 5A. The charges are formed on a dielectric layer of an electrode, but for ease of explanation, it is described that the charges are formed at the electrode.

As shown in FIG. 5A, the scan electrode 10 is coupled to a current source $I_{in}$ through a switch SW, and the sustain electrode 20 is coupled to the voltage of $V_e$. Dielectric layers 30 and 40 are respectively formed covering the scan electrode 10 and the sustain electrode 20. Discharge gas (not shown) is injected between the dielectric layers 30 and 40, and the area provided between the dielectric layers 30 and 40 forms a discharge space 50.

Since the scan and sustain electrodes 10 and 20, the dielectric layers 30 and 40, and the discharge space 50 form a capacitive load, they may be represented as a panel capacitor $C_p$, as shown in FIG. 5B. In FIG. 5A, $\in_r$ is the dielectric constant of the dielectric layers 30 and 40, $V_g$ is a voltage at the discharge space 50, $d_1$ is the thickness of the dielectric layers 30 and 40, and $d_2$ is the distance between the dielectric layers 30 and 40 (the width of the discharge space).

The voltage of $V_y$ applied to the scan electrode of the panel capacitor Cp decreases in proportion to time when the switch SW is turned on, as given in Equation 1. That is, when the switch SW turns on, the scan electrode voltage $V_y$ decreases. In FIGS. 5A to 5E, the voltage at the scan electrode is reduced by using the current source $I_{in}$. However, the voltage at the scan electrode may be reduced by directly applying a reduced amount of voltage to the scan electrode or discharging the panel capacitor $C_p$.

$$V_y = V_y(0) - \frac{I_{in}}{C_p}t \qquad \text{Equation 1}$$

where $V_y(0)$ is a scan electrode voltage $V_y$ when the switch SW turns on, and $C_p$ is the capacitance of the panel capacitor $C_p$.

Referring to FIG. 5C, the voltage $V_g$, applied to the discharge space 50 when no discharge occurs while the switch SW is turned on, may be calculated, assuming that the voltage applied to the scan electrode 10 is $V_{in}$.

When the voltage of $V_{in}$ is applied to the scan electrode, the charges $-\sigma_t$ may be applied to the scan electrode 10, and the charges $+\sigma_t$ may be applied to the sustain electrode 20. By applying the Gaussian theorem, the electric field $E_1$ within the dielectric layers 30 and 40 and the electric field $E_2$ within the discharge space 50 may be given as Equations 2 and 3.

$$E_1 = \frac{\sigma_t}{\varepsilon_r \varepsilon_0} \qquad \text{Equation 2}$$

where $\sigma_t$ is charges applied to the scan electrode and the sustain electrode, and $\in_0$ is a permittivity within the discharge space.

$$E_2 = \frac{\sigma_t + \sigma_w}{\varepsilon_0} \qquad \text{Equation 3}$$

The voltage of $(V_e - V_{in})$ applied outside the discharge space may be given as Equation 4 according to a relation between electric fields and distances, and the voltage of $V_g$ of the discharge space 50 may be given as Equation 5.

$$2d_1E_1 + d_2E_2 = V_e - V_{in} \qquad \text{Equation 4}$$

$$V_g = d_2E_2 \qquad \text{Equation 5}$$

From Equations 2, 3, 4 and 5, the charges $\sigma_t$ applied to the scan electrode 10 or the sustain electrode 20, and the voltage $V_g$ within the discharge space 50, may be respectively given as Equations 6 and 7.

$$\sigma_t = \frac{V_e - V_{in} - \frac{d_2}{\varepsilon_0}\sigma_w}{\frac{d_2}{\varepsilon_0} + \frac{2d_1}{\varepsilon_r\varepsilon_0}} = \frac{V_e - V_{in} - V_w}{\frac{d_2}{\varepsilon_0} + \frac{2d_1}{\varepsilon_r\varepsilon_0}} \qquad \text{Equation 6}$$

where $V_w$ is a voltage formed by the wall charges $\sigma_w$ in the discharge space 50.

$$V_g = \frac{\varepsilon_r d_2}{\varepsilon_r d_2 + 2d_1}(V_e - V_{in} - V_w) + V_w = \alpha(V_e - V_{in}) + (1-\alpha)V_w \qquad \text{Equation 7}$$

Actually, since the widht $d_2$ of the discharge space 50 is a very large value compared to the thickness $d_1$ of the dielectric layers 30 and 40, $\alpha$ almost reaches 1. That is, Equation 7 shows that the externally applied voltage of $(V_e - V_{in})$ may be applied to the discharge space 50.

Referring to FIG. 5D, the voltage $V_{g1}$ within the discharge space 50 may be calculated when the wall charges formed at the scan electrode 10 and the sustain electrode 20 are quenched by the amount of $\sigma_w'$ because of the discharging caused by the externally applied voltage of $(V_e - V_{in})$. The charges applied to the scan electrode and the sustain electrode 20 may increase to $\sigma_t'$ since the power $V_{in}$ supplies the charges to maintain the potential of the electrodes when the wall charges are formed.

By applying the Gaussian theorem in FIG. 5D, the electric field $E_1$ within the dielectric layers 30 and 40 and the electric field E2 within the discharge space 50 may be given is as Equation 8 and 9.

$$E_1 = \frac{\sigma_t'}{\varepsilon_r \varepsilon_0} \qquad \text{Equation 8}$$

$$E_2 = \frac{\sigma_t' + \sigma_w - \sigma_w'}{\varepsilon_0} \qquad \text{Equation 9}$$

From Equations 8 and 9, the charges $\sigma_t'$ applied to the scan electrode 10 and the sustain electrode 20, and the voltage $V_{g1}$ within the discharge space, may be given as Equations 10 and 11.

$$\sigma_t' = \frac{V_e - V_{in} - \frac{d_2}{\varepsilon_0}(\sigma_w - \sigma_w')}{\frac{d_2}{\varepsilon_0} + \frac{2d_1}{\varepsilon_r\varepsilon_0}} = \frac{V_e - V_{in} - V_w + \frac{d_2}{\varepsilon_0}\sigma_w'}{\frac{d_2}{\varepsilon_0} + \frac{2d_1}{\varepsilon_r\varepsilon_0}} \quad \text{Equation 10}$$

$$V_{g1} = d_2E_2 = \alpha(V_e - V_{in}) + (1-\alpha)V_w - (1-\alpha)\frac{d_2}{\varepsilon_0}\sigma_w' \quad \text{Equation 11}$$

Since $\alpha$ is almost 1 in Equation 11, a small voltage decrease may be generated within the discharge space 50 when applying the voltage $V_{in}$ to generate a discharge. Therefore, when the amount $\sigma_w'$ of the wall charges reduced by the discharge is high, the voltage $V_{g1}$ within the discharge space 50 decreases, and the discharge is quenched.

Referring to FIG. 5E, the voltage $V_{g2}$ within the discharge space 50 may be calculated. Here, the switch SW is turned off (i.e., the discharge space 50 is floated) after the wall charges formed at the scan and sustain electrodes 10 and 20 are quenched by the amount of $\sigma_w'$ because of the discharge caused by the externally applied voltage $V_{in}$. Since no external charge is applied, the charges applied to the scan and sustain electrodes 10 and 20 become $\sigma_t$ in the same manner of FIG. 5C. By applying the Gaussian theorem, the electric field $E_1$ within the dielectric layers 30 and 40 and the electric field $E_2$ within the discharge space 50 may be given as Equation 2 and 12.

$$E_2 = \frac{\sigma_t + \sigma_w - \sigma_w'}{\varepsilon_0} \quad \text{Equation 12}$$

From Equations 12 and 6, the voltage $V_{g2}$ of the discharge space 50 may be given as Equation 13.

$$V_{g2} = d_2E_2 = \alpha(V_e - V_{in}) + (1-\alpha)V_w - \frac{d_2}{\varepsilon_0}\sigma_w' \quad \text{Equation 13}$$

Equation 13 shows that the quenched wall charges may generate a significant voltage decrease when the switch SW is turned off (floated). That is, as Equations 12 and 13 show, the voltage falling intensity caused by the wall charges in the floated state of the electrode may be $1/(1-\alpha)$ times larger than that of the voltage applying state. Consequently, since the voltage within the discharge space 50 may be substantially reduced in the floated state when a small amount of charges decrease, the voltage between the electrodes becomes less than the discharge firing voltage, and the discharge may be steeply quenched. That is, the operation of floating the electrode after starting the discharge may function as an intense discharge quenching mechanism. When the voltage within the discharge space 50 decreases, as shown in FIG. 4, the is voltage $V_y$ at the floated scan electrode increases by a predetermined voltage since the sustain electrode is fixed at the voltage of $V_e$.

Referring to FIG. 4, floating the scan electrode when the scan electrode voltage falls to cause a discharge, quenches the discharge with a slight reduction in wall charges formed at the scan and sustain electrodes, according to the discharge quenching mechanism. Repeating this operation may erase the wall charges formed at the scan and sustain electrodes step by step, thereby controlling the wall charges to reach a desired state. That is, the wall charges may be accurately controlled in the falling period $P_{r2}$ of the reset period $P_r$ to achieve a desired wall charge state.

The exemplary embodiment of the present invention is described during the falling period $P_{r2}$ of the reset period $P_r$, but the present invention is not restricted thereto. It may be applicable to cases of controlling the wall charges by using the falling waveform.

Figure 6:
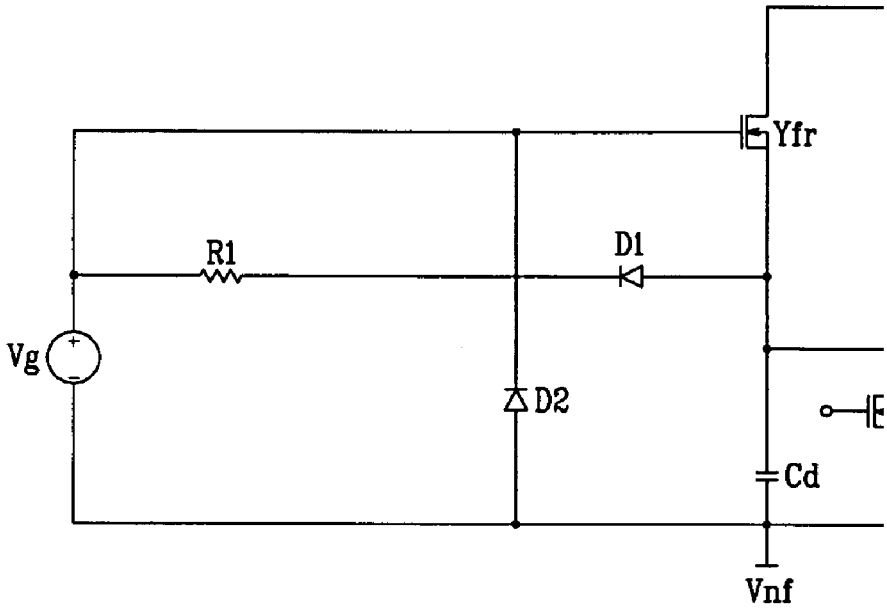
FIG. 6 is a schematic circuit diagram according to a first exemplary embodiment of the present invention.
Figure 7:
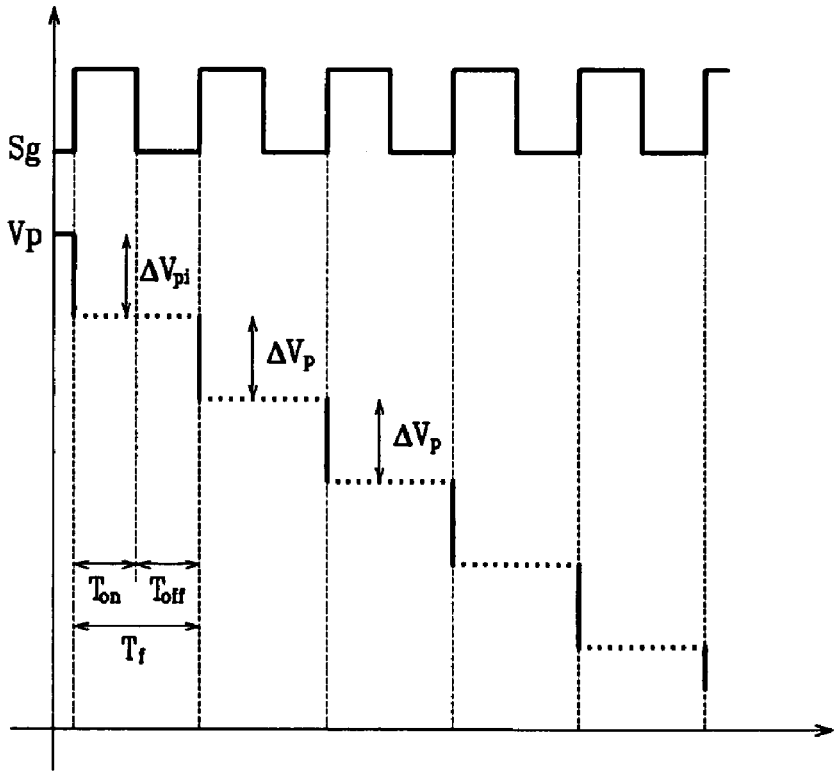
FIG. 7 is a driving waveform diagram for the driving circuit of FIG. 6.

Referring to FIG. 6 and FIG. 7, a driving circuit for generating a falling waveform will be described. This driving circuit may be formed as part of the Y electrode driver 500 of FIG. 2.

FIG. 6 is a brief circuit diagram showing the driving circuit according to a first exemplary embodiment of the present invention, and FIG. 7 is a driving waveform diagram showing driving signals that may be applied to the driving circuit of FIG. 6. Referring to FIG. 6, a panel capacitor $C_p$ represents a capacitive load between the scan and sustain electrode as shown in FIG. 5A. It is assumed that a ground voltage is applied to a second end of the panel capacitor $C_p$, (i.e., the sustain electrode), and the panel capacitor $C_p$ is charged with a predetermined amount of charges.

As shown in FIG. 6, the driving circuit according to the first exemplary embodiment may include transistors $Y_{fr}$ and $Y_{rc}$, a capacitor $C_d$, a resistor $R_1$, diodes $D_1$ and $D_2$, and a control signal voltage source $V_g$. The capacitor $C_d$, the resistor $R_1$, the diodes $D_1$ and $D_2$, and the control signal voltage source $V_g$ may be driven by a driver that drives the transistor $Y_{fr}$, and the voltage of the scan electrode may fall by operation of the driver, as shown in FIG. 3 and FIG. 4.

In FIG. 6, the transistors $Y_{fr}$ and $Y_{rc}$ are depicted as n channel MOSFETs. However, other switching elements performing similar functions may be used instead of the transistors $Y_{fr}$ and $Y_{rc}$. A drain, which is one of two main ends of the transistor $Y_{fr}$, may be coupled to the scan electrode, which is a first end of the panel capacitor $C_p$, and a source, which is the other main end of the transistor $Y_{fr}$, may be coupled to a first end of the capacitor $C_d$. A second end of the capacitor $C_d$ may be coupled to a power $V_{nf}$ supplying the voltage of $V_{nf}$. The control signal voltage source $V_g$ may be coupled between a gate, which is a control end of the transistor $Y_{fr}$, and the power $V_{nf}$, and it supplies a control signal $S_g$ to the transistor $Y_{fr}$.

The diode $D_1$ and the resistor $R_1$ may be coupled between the first end of the capacitor $C_d$ and the control signal voltage source $V_g$, and they may form a discharging path for the capacitor $C_d$. The diode $D_2$ may be coupled between the power $V_{nf}$ and the gate of the transistor $Y_{fr}$, and it clamps the gate voltage of the transistor $Y_{fr}$. In other words, the transistor $Y_{fr}$ may be coupled to the capacitor $C_d$ in parallel. A resistor (not shown) may be additionally coupled between the control signal voltage source $V_g$ and the transistor $Y_{fr}$, and a resistor (not shown) may be also coupled between the gate of the transistor $Y_{fr}$ and the power $V_{nf}$.

An operation of the driving circuit of FIG. 6 will be described with reference to FIG. 7. For ease of description, FIG. 7 shows a waveform where no discharge is generated. In the case that a discharge occurs, the waveform of FIG. 7 will be given such that the voltage $V_p$ of the panel capacitor Cp increases in the floating period, as shown in the waveform of FIG. 4.

Referring to FIG. 7, the control signal $S_g$ supplied from the control signal voltage source $V_g$ alternates between a high level voltage for turning on the transistor $Y_{fr}$, and a low level voltage for turning off the transistor $Y_{rc}$.

When the control signal $S_g$ has the high level voltage for turning on the transistor $Y_{fr}$, the charges accumulated on the panel capacitor $C_p$ move to the capacitor $C_d$. As the capacitor $C_d$ is charged, its first end voltage and the source voltage of the transistor $Y_{fr}$ increase. Herein, the gate voltage of the transistor $Y_{fr}$ may be maintained at the voltage that turned it on, but the first end voltage of the capacitor $C_d$ increases. Therefore, the source voltage of the transistor $Y_{fr}$ increases as compared to its gate voltage. When the source voltage of the transistor $Y_{fr}$ increases to a predetermined voltage, the voltage between the gate and the source (the gate-source voltage) of the transistor $Y_{fr}$ becomes less than the threshold voltage $V_t$ of the transistor $Y_{fr}$, thus turning off the transistor $Y_{fr}$.

In other words, the transistor $Y_{fr}$ turns off when the difference between the high level voltage of the control signal $S_g$ and its source voltage is less than its threshold voltage $V_t$. When the transistor $Y_{fr}$ turns off, the voltage supplied to the panel capacitor $C_p$ is cut off, thereby floating the panel capacitor $C_p$. Consequently, the amount of charges $\Delta Q_i$ charged in the capacitor $C_d$ may be given as Equation 14. Herein, the voltage of the panel capacitor $C_p$ may be immediately reduced by the predetermined voltage because the charges move immediately to the capacitor $C_d$ from the panel capacitor $C_p$. Therefore, the panel capacitor $C_p$ may be floated faster than the case in which the panel capacitor $C_p$ is floated by controlling the level of the control signal $S_g$. Furthermore, the floating period $T_f$ may be longer than the voltage applying period since the transistor $Y_{fr}$ is still turned off when the control signal $S_g$ is the low level voltage.

$$\Delta Q_i = C_d(V_{cc} - V_t) \quad \text{Equation 14}$$

where $V_{cc}$ is the high level voltage of the control signal $S_g$, and $C_d$ is the capacitance of the capacitor $C_d$.

Additionally, the voltage variation $\Delta V_{pi}$ of the panel capacitor $C_p$ may be given as Equation 15 since the charges $\Delta Q_i$ charged in the capacitor $C_d$ are supplied from the panel capacitor $C_p$.

$$\Delta V_{pi} = \frac{\Delta Q_i}{C_p} = \frac{C_d}{C_p}(V_{cc} - V_t) \quad \text{Equation 15}$$

When the control signal $S_g$ becomes the low level, the capacitor $C_d$ may be discharged through a path including the capacitor $C_d$, the diode $D_1$, the resistor $R_1$, and the control signal voltage source $V_g$, since the first end voltage of the capacitor $C_d$ is higher than the control signal voltage source $V_g$. Herein, the capacitor $C_d$ may be discharged in the state in which the capacitor $C_d$ is charged to $(V_{cc}-V_t)$ voltage, and thus the amount $\Delta V_d$ of the reduced voltage of the capacitor $C_d$ by the discharge may be given as Equation 16.

$$\Delta V_d = (V_{cc} - V_t)e^{-\frac{1}{R_1 C_d}t} \quad \text{Equation 16}$$

where $R_1$ is the resistance of the resistor $R_1$.

Additionally, the amount of charges $\Delta Q_d$ discharged from the capacitor $C_d$ may be given as Equation 17 according to the low level time $T_{off}$ of the control signal $S_g$. Therefore, the amount of charges $Q_d$ remaining in the capacitor $C_d$ may be given as Equation 18.

$$\begin{aligned}\Delta Q_d &= C_d(V_{cc} - V_t) - C_d(V_{cc} - V_t)e^{-\frac{1}{R_1 C_d}T_{off}} \\ &= C_d(V_{cc} - V_t)\left(1 - e^{-\frac{1}{R_1 C_d}T_{off}}\right)\end{aligned} \quad \text{Equation 17}$$

-continued $$Q_d = \Delta Q_i - \Delta Q_d \quad \text{Equation 18}$$

When the control signal $S_g$ becomes the high level voltage again, the transistor $Y_{fr}$ turns on and charges move from the panel capacitor $C_p$ to the capacitor $C_d$. As described above, the transistor $Y_{fr}$ turns off when the capacitor $C_d$ is charged to the charges $\Delta Q_i$. Therefore, the transistor $Y_{fr}$ turns off when the charges $\Delta Q_i$ move from the panel capacitor $C_p$ to the capacitor $C_d$. Consequently, the amount $\Delta V_p$ of the reduced voltage of the panel capacitor $C_p$ may be given as Equation 19.

$$\Delta V_p = \frac{\Delta Q_d}{C_p} = \frac{C_d}{C_p}(V_{cc} - V_t)\left(1 - e^{-\frac{1}{R_1 C_d}T_{off}}\right) \quad \text{Equation 19}$$

As described above, when the voltage of the panel capacitor $C_p$ decreases by $\Delta V_p$ voltage, the voltage of the capacitor $C_d$ increases so that the transistor $Y_{fr}$ turns off. When the control signal $S_g$ becomes the low level voltage, the capacitor $C_d$ discharges, and the transistor $Y_{fr}$ maintains its turned-off state. Therefore, reducing the voltage of the panel capacitor $C_p$ in response to the high level control signal $S_g$ and floating the panel capacitor $C_p$ in response to the increase of the voltage of the capacitor $C_d$ repeats. That is, reducing the voltage of the electrode and floating the electrode may be repeated.

An operation of the transistor $Y_{rc}$ in the driving circuit of FIG. 6 will be described hereinafter. In the driving circuit of FIG. 6, when the voltage of the panel capacitor $C_p$ is reduced less than a predetermined voltage, the amount of charges moved from the panel capacitor $C_p$ to the capacitor $C_d$ decreases, and the voltage of the capacitor $C_d$ becomes less than the voltage of $(V_{cc}-V_t)$. As a result, the floating period $T_{off}$ shortens since the transistor $Y_{fr}$ is not turned off by the voltage of the capacitor $C_d$. Additionally, the voltage discharged from the capacitor $C_d$ also decreases as described in Equation 16 when the voltage of the capacitor $C_d$ is less than the voltage of $(V_{cc}-V_t)$. Therefore, the amount of charges moved from the panel capacitor $C_p$ to the capacitor $C_d$ decreases when the transistor $Y_{fr}$ is turned on. Considering that the amount of the reduced voltage decreases at the end region of the falling waveform shown in FIG. 7, the voltage of the panel capacitor $C_p$ may not be reduced to the desired voltage during the given time.

When the voltage of the panel capacitor $C_p$ is lower than the predetermined voltage, and thus the amount of charges moved from the panel capacitor $C_p$ to the capacitor $C_d$ decreases, a signal for turning on the transistor $Y_{rc}$ may be applied to the gate, which is a control end of the transistor $Y_{rc}$. Then, the transistor $Y_{rc}$ turns on and the voltage of the capacitor $C_d$ is discharged to the power $V_{nf}$ through the transistor $Y_{rc}$. Therefore, the voltage of the panel capacitor $C_p$ may be rapidly reduced to the desired voltage since the voltage charged in the panel capacitor $C_p$ may be discharged before the transistor $Y_{rc}$ turns on.

In the driving circuit of FIG. 6, a discharging path is formed to repeatedly reduce the voltage of the electrode and float the electrode. However, the discharging path may be removed when reducing the voltage of the electrode and floating the electrode a single time. Further, the discharging path may be formed differently. For example, the discharging path may be formed by coupling a switching element between the first end of the capacitor $C_d$ and the power $V_{nf}$. In this case, the switching element may be turned on during the period of time $T_{off}$ for discharging the capacitor $C_d$.

Furthermore, referring to Equation 19, the amount of the reduced voltage of the panel capacitor $C_p$ may be controlled by controlling the duty ratio of the control signal $S_g$, since the reduced voltage of the panel capacitor $C_p$ is determined by the resistor $R_1$ and the low level period $T_{off}$ of the control signal $S_g$. The amount of the reduced voltage of the panel capacitor $C_p$ may also be controlled by adjusting the resistance of a variable resistor that may be coupled to the resistor $R_1$ in parallel.

Additionally, a resistor may be coupled between the panel capacitor $C_p$ and the transistor $Y_{fr}$ to restrict the current discharged from the panel capacitor $C_p$. Alternatively, any other element that can restrict the current discharged from the panel capacitor $C_p$, such as an inductor (not shown), may be used instead of the resistor.

In the driving circuit of FIG. 6, the current flowing from the first end of the capacitor $C_d$ to its second end is controlled by the gate-source voltage of the transistor $Y_{fr}$ since the transistor $Y_{fr}$ is turned off when the capacitor $C_d$ is charged to the predetermined voltage. However, because a body diode may be formed in the transistor $Y_{fr}$, in a direction from the source to the drain, when it is a MOSFET, a current may flow from the second end of the capacitor $C_d$ to its first end when the voltage of the panel capacitor $C_p$ is less than a voltage of the voltage source to which the capacitor $C_d$ is coupled (the voltage source is the power $V_{nf}$ in FIG. 6). Additionally, the capacitor $C_d$ may be charged continuously because there is no means for controlling this current in the driving circuit of FIG. 6. Then, the second end voltage of the capacitor $C_d$ is higher than its first end voltage by the voltage charged in it. Thus, the gate voltage of the transistor $Y_{fr}$ is higher than the first end voltage of the capacitor $C_d$, i.e., the source voltage of the transistor $Y_{fr}$ caused by the voltage charged in the capacitor $C_d$. Consequently, the gate-source voltage of the transistor $Y_{fr}$ may be increased by the voltage charged in the capacitor $C_d$, which may damage the transistor if this voltage is higher than its withstand voltage.

Hereinafter, a driving circuit that may prevent damage to the transistor $Y_{fr}$ by the current flowing from the second end of the capacitor $C_d$ to the first end thereof will be described with reference to FIG. 8 and FIG. 9.

Figure 8:
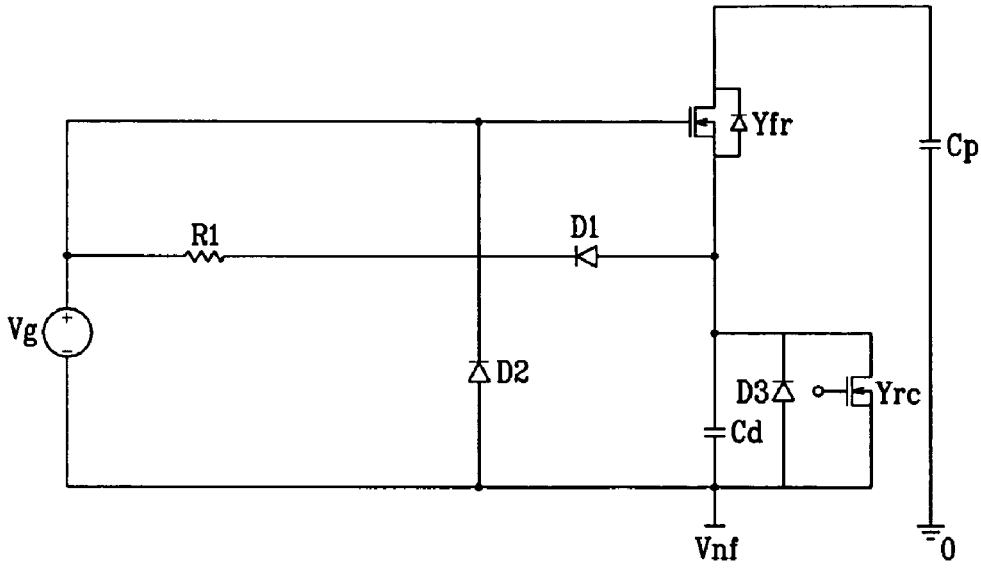
FIG. 8 and FIG. 9 are schematic circuit diagrams according to second and third exemplary embodiments of the present invention, respectively.
Figure 9:
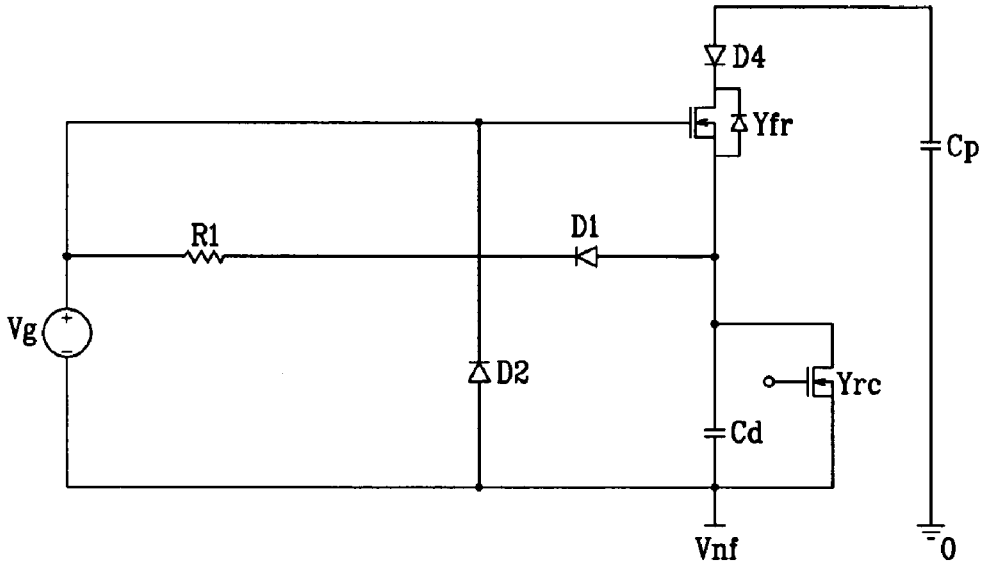

FIG. 8 and FIG. 9 are schematic circuit diagrams showing the driving circuits according to second and third exemplary embodiments of the present invention, respectively. For ease of description, the body diode of the transistor $Y_{fr}$ is shown in FIG. 8 and FIG. 9.

Referring to FIG. 8, the driving circuit of the second exemplary embodiment and the driving circuit of FIG. 6 are the same except for a diode $D_3$ coupled to the capacitor $C_d$ in parallel. An anode of the diode $D_3$ may be coupled to the second end of the capacitor $C_d$, and its cathode may be coupled to the first end of the capacitor $C_d$. Then, the current generated by the body diode of the transistor $Y_{fr}$ may flow through the diode $D_3$ when the second end voltage of the capacitor $C_d$ is higher than the voltage of the panel capacitor $C_p$. Therefore, the capacitor $C_d$ is not charged by this current. Consequently, the gate-source voltage of the transistor $Y_{fr}$ may not exceed its withstand voltage.

Additionally, as shown in FIG. 9, the driving circuit according to the third exemplary embodiment and the driving circuit of FIG. 6 are the same except for a diode $D_4$ coupled between the panel capacitor $C_p$ and the transistor $Y_{fr}$. An anode of the diode $D_4$ may be coupled to the first end of the panel capacitor $C_p$, and its cathode may be coupled to the drain of the transistor $Y_{fr}$. Then, the current that may be generated by the body diode of the transistor $Y_{fr}$ is intercepted since the diode is formed in the opposite direction of the transistor's body diode. In FIG. 9, the diode $D_4$ is coupled between the panel capacitor $C_p$ and the transistor $Y_{fr}$, but it may be formed in any position on the path including the panel capacitor $C_p$, the transistor $Y_{fr}$, and the capacitor $C_d$.

Figure 10:
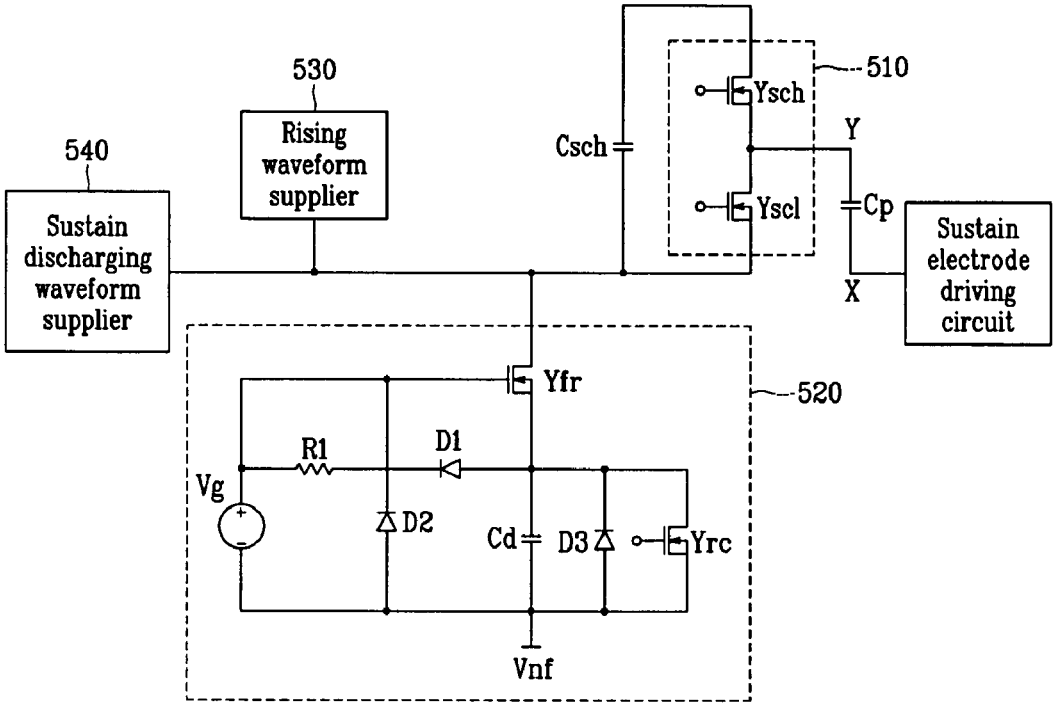
FIG. 10 and FIG. 11 are scan electrode diving circuit diagrams according to fourth and fifth exemplary embodiments of the present invention, respectively.
Figure 11:
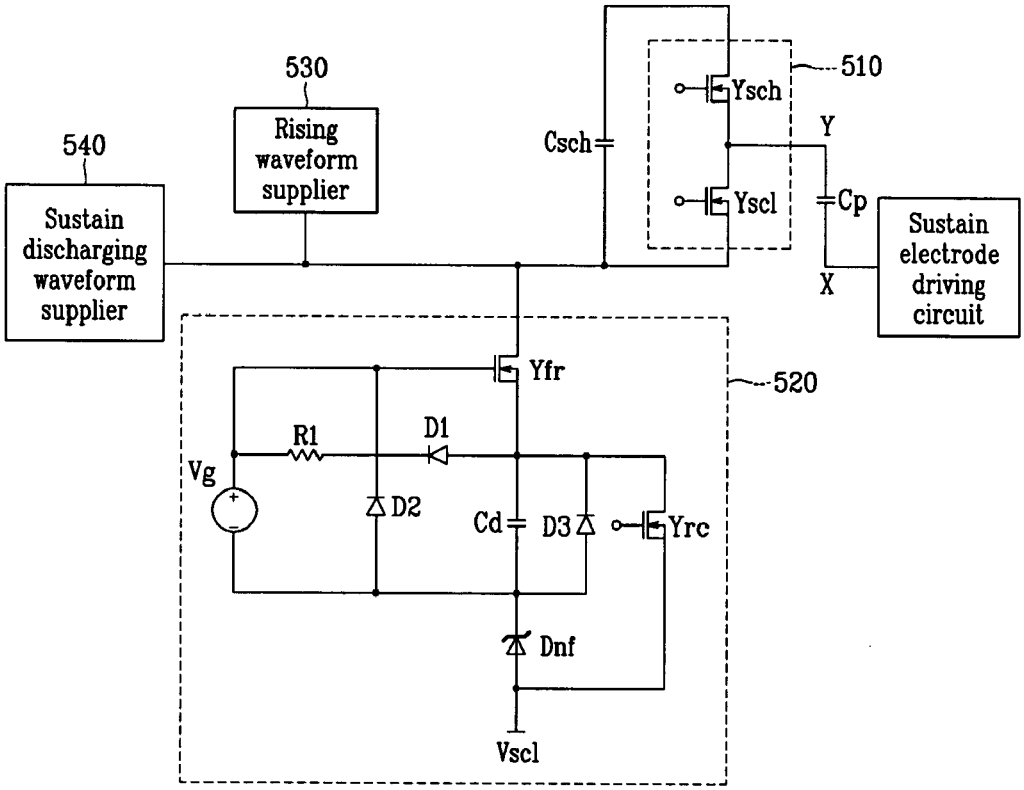

A scan electrode driving circuit for generating a falling waveform in the falling period $Pr_2$ of the reset period $P_r$, that may use the driving circuits described in the first to third exemplary embodiments of the present invention, will be described hereinafter with reference to FIG. 10 and FIG. 11. FIG. 10 and FIG. 11 show a scan electrode driving circuit according to fourth and fifth exemplary embodiments of the present invention, respectively.

Typically, a selecting circuit 510 is coupled as an integrated circuit to the respective scan electrodes Y1 to Yn so as to sequentially select the scan electrodes Y1 to Yn during the address period. FIG. 10 and FIG. 11 show one Y electrode and one selecting circuit 510, for ease of description. Further, the panel capacitor $C_p$ is a capacitive load between the Y electrode and the X electrode, which is adjacent to the Y electrode. Additionally, a sustain electrode driving circuit is coupled to the X electrode.

Referring to FIG. 10, the scan electrode driving circuit according to the fourth exemplary embodiment of the present invention may include a selecting circuit 510, a capacitor $C_{sch}$, a falling waveform supplier 520, a rising waveform supplier 530, and a sustain discharging waveform supplier 540. The capacitor $C_{sch}$ is charged with the voltage of $V_{sch}$, and it may be charged by a power (not shown) coupled to its first end.

The selecting circuit 510 may include two transistors $Y_{sch}$ and $Y_{scl}$, and a body diode may be formed in each of these transistors in the direction from the source to the drain. The source of the transistor $Y_{sch}$ and the drain of the transistor $Y_{scl}$ may be coupled to the Y electrode of the panel capacitor Cp. The first end of the capacitor $C_{sch}$ may be coupled to the drain of the transistor $Y_{sch}$, and a second end of the capacitor $C_{sch}$ may be coupled to the source of the transistor $Y_{scl}$. Further, the source of the transistor $Y_{scl}$ may be coupled with the falling waveform supplier 520, the rising waveform supplier 530, and the sustain discharging waveform supplier 540.

The falling waveform supplier 520 supplies a falling waveform to the Y electrode during the falling period $P_{r2}$ of the reset period $P_r$ of FIG. 3. The driving circuit of FIG. 6, FIG. 8, and FIG. 9 may be applied thereto. In FIG. 10, the driving circuit of FIG. 8 is used for the falling waveform supplier 520. The rising waveform supplier 530 supplies a rising waveform to the Y electrode during the rising period $P_{r1}$ of the reset period $P_r$, and a circuit supplying a rising voltage in a typical ramp shape may be used therefor. The sustain discharging waveform supplier 540 supplies a sustain discharging waveform to the Y electrode during the sustain period $P_s$ of FIG. 3.

A method of supplying voltages to the Y electrode during the address period $P_a$ of FIG. 3 will be described hereinafter, assuming that the selecting voltage $V_{scl}$ and the final voltage $V_{nf}$ of the falling period $P_{r2}$ are equal.

The transistors $Y_{fr}$, $Y_{rc}$, and $Y_{sch}$ are turned on and the transistor $Y_{scl}$ is turned off when the Y electrode is not selected, thereby applying a voltage of $V_{sch}$ through the transistor $Y_{sch}$. That is, the Y electrode that is not selected may be biased at the voltage of $V_{sch}$.

To select the Y electrode, the transistor $Y_{sch}$ turns off, and the transistor $Y_{scl}$ turns on while the transistors $Y_{fr}$ and $Y_{rc}$ are on. Then, the voltage at the Y electrode decreases to the voltage of $V_{nf}$ through the transistor $Y_{scl}$. In other words, the selecting voltage $V_{nf}$ is applied to the selected Y electrode, as shown in FIG. 3, assuming that $V_{scl}$ equals $V_{nf}$. When selecting another Y electrode, the transistor $Y_{sch}$ turns on and the transistor $Y_{scl}$ turns off, thus biasing the Y electrode at the voltage of $V_{sch}$.

According to the fourth exemplary embodiment of the present invention, the falling waveform supplier 520 may apply the selecting voltage in the address period to the Y electrode. Accordingly, a transistor for supplying the selecting voltage may be removed.

Further, while the selecting voltage in the address period $P_a$ and the final voltage $V_{nf}$ of the falling period Pr2 are assumed to be the same in the fourth exemplary embodiment, the selecting voltage $V_{scl}$ may be less than the final voltage $V_{nf}$.

Referring to FIG. 11, a falling waveform supplier 520 according to the fifth exemplary embodiment of the present invention may include what the falling waveform supplier 520 shown in FIG. 10 includes, and it may further include a zener diode $D_{nf}$. In this case, the second end of the capacitor $C_d$ may be coupled to a cathode of the zener diode $D_{nf}$, and an anode of the zener diode $D_{nf}$ may be coupled to a power supplying the selecting voltage $V_{scl}$. It is assumed that a breakdown voltage $V_z$ of the zener diode $D_{nf}$ is a voltage ($V_{nf}-V_{scl}$), which is the difference between the final voltage $V_{nf}$ and the selecting voltage $V_{scl}$. In this way, the transistors $Y_{fr}$ and $Y_{rc}$ are turned on during the address period $P_a$ to transmit the selecting voltage $V_{scl}$. The voltage at the second end of the capacitor $C_d$ substantially becomes the voltage of $V_{nf}$ by the zener diode $D_{nf}$ in the falling period $P_{r2}$ of the reset period $P_r$, and therefore a final voltage in the falling period $P_{r2}$ may be the voltage of $V_{nf}$. Further, the transistor $Y_{rc}$ may be turned on to discharge the capacitor $C_d$ through a path including the capacitor $C_d$, the transistor $Y_{rc}$, and the zener diode $D_{nf}$, in the latter part of the falling period $P_{r2}$.

The scan electrode driving circuits of FIG. 10 and FIG. 11 use the transistor that supplies the falling waveform to supply the selecting voltage, according to the exemplary embodiments of the present invention. Further, the present invention may be applicable in a case that the falling waveform supplier 520 gradually reduces the voltage of the scan electrode without using a driver generating ramp waveforms.

According to exemplary embodiments of the present invention, the wall charges may be quickly and stably erased in the reset period, and the number of transistors may be reduced by using the transistor used in the reset period again in the address period.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus of a plasma display panel having a capacitive load formed by at least two electrodes, comprising:

a first transistor having a first main end coupled to a first electrode of the capacitive load;

a capacitor having a first end coupled to a second main end of the first transistor and a second end coupled to a first power supplying a first voltage; and a second transistor coupled between the second main end of the first transistor and a second power supplying a second voltage, wherein the capacitor receives charges from the capacitive load when the first transistor turns on;

wherein a voltage at the first electrode is reduced by repeating a process of turning on and turning off the first transistor during a reset period; and wherein the first transistor and the second transistor turn on during an address period such that the second voltage is applied to the first electrode via the first transistor and the second transistor.

2. The driving apparatus of claim 1, wherein the voltage at the first electrode is reduced due to the charges moving from the capacitive load to the capacitor when the first transistor turns on, and the first transistor turns off when a predetermined amount of charges moves to the capacitor.

3. The driving apparatus of claim 2, wherein the first transistor turns off due to a difference between a second main end voltage and a control end voltage of the first transistor; and wherein the difference is caused by the predetermined amount of charges moved to the capacitor.

4. The driving apparatus of claim 2, further comprising a discharge path for discharging at least a portion of the predetermined amount of charges charged in the capacitor.

5. The driving apparatus of claim 4, wherein charges move from the capacitive load to the capacitor when the first transistor turns on after the capacitor is discharged.

6. The driving apparatus of claim 4, wherein a control signal having a first level and a second level is applied to a control end of the first transistor;

wherein the first transistor turns on in response to the first level; and wherein the discharge path forms in response to the second level.

7. The driving apparatus of claim 6, wherein the control signal is supplied by a control signal voltage source coupled between the control end of the first transistor and the second end of the capacitor.

8. The driving apparatus of claim 4, wherein the discharge path comprises a resistor and a diode interrupting a current flowing in a direction for charging the capacitor.

9. The driving apparatus of claim 1, further comprising a diode formed in a direction for interrupting the current that has passed through a body diode of the first transistor flowing to the capacitor.

10. The driving apparatus of claim 1, further comprising a diode, wherein an anode of the diode is coupled to the second end of the capacitor and a cathode of the diode is coupled to the first end of the capacitor.

11. The driving apparatus of claim 1, further comprising a diode, wherein an anode of the diode is coupled to the first electrode and a cathode of the diode is coupled to the first main end of the first transistor.

12. The driving apparatus of claim 1, wherein the first voltage and the second voltage are the same.

13. The driving apparatus of claim 1, further comprising:

a zener diode coupled between the second end of the capacitor and the second power, wherein the first voltage is a sum of the second voltage and a breakdown voltage of the zener diode.

14. The driving apparatus of claim 1, wherein during the reset period, the second transistor is turned on when the voltage at the first electrode is reduced to a third voltage; and wherein the third voltage is higher than the first voltage.

15. The driving apparatus of claim 1, further comprising:

a second capacitor;

a third transistor; and a fourth transistor, wherein the first main end of the first transistor is coupled to a node of a second end of the second capacitor and a source electrode of the third transistor;

wherein a first end of the second capacitor is coupled to a drain electrode of the fourth transistor; and wherein the first electrode of the capacitive load is coupled to a source electrode of the fourth transistor and a drain electrode of the third transistor.

16. A driving apparatus of a plasma display panel having a capacitive load formed by at least two electrodes, comprising:

a first transistor having a first main end coupled to a first electrode of the capacitive load;

a driver coupled between a control end and a second main end of the first transistor and a first power supplying a first voltage; and a second transistor coupled between the second main end of the first transistor and a second power supplying a second voltage, wherein the driver controls an operation of the first transistor to gradually reduce a voltage at the first electrode during a reset period;

wherein the second voltage is supplied to the first electrode via the first transistor and the second transistor when the first transistor and the second transistor are turned on during an address period.

17. The driving apparatus of claim 16, wherein the driver repeatedly turns on the first transistor to reduce the voltage at the first electrode and turns off the first transistor to float the first electrode to gradually reduce the voltage at the first electrode.

18. The driving apparatus of claim 16, further comprising:

a zener diode coupled between the driver and the second power, wherein the first voltage is a sum of the second voltage and a breakdown voltage of the zener diode.

19. The driver apparatus of claim 16, wherein during the reset period, the second transistor is turned on when the voltage at the first electrode is reduced to a third voltage; and wherein the third voltage is higher than the first voltage.

* * * * *